US010729209B2

(12) United States Patent
Blanc et al.

(10) Patent No.: US 10,729,209 B2
(45) Date of Patent: Aug. 4, 2020

(54) WATCH BAND

(71) Applicants: Smith Blanc, Coral Springs, FL (US); Jamarl Kevin Simon, Weston, FL (US); Claude Cadet, Davie, FL (US)

(72) Inventors: Smith Blanc, Coral Springs, FL (US); Jamarl Kevin Simon, Weston, FL (US); Claude Cadet, Davie, FL (US)

( * ) Notice: Subject to any disclaimer, the term of this patent is extended or adjusted under 35 U.S.C. 154(b) by 65 days.

(21) Appl. No.: 16/115,910

(22) Filed: Aug. 29, 2018

(65) Prior Publication Data

US 2018/0368539 A1 Dec. 27, 2018

Related U.S. Application Data

(63) Continuation-in-part of application No. 29/533,163, filed on Jul. 15, 2015, now Pat. No. Des. 828,208.

(51) Int. Cl.

| | |
|---|---|
| ***A44C 5/10*** | (2006.01) |
| ***A44C 5/02*** | (2006.01) |
| ***A44C 5/00*** | (2006.01) |
| ***A44C 17/02*** | (2006.01) |

(52) U.S. Cl.

CPC ..... *A44C 5/107* (2013.01); *A44C 5/0007* (2013.01); *A44C 5/027* (2013.01); *A44C 17/0208* (2013.01); *A44C 5/0053* (2013.01); *A44C 5/102* (2013.01)

(58) Field of Classification Search

CPC ..... A44C 17/0233; A44C 17/0208; A44C 17/0216; A44C 17/0225; A44C 5/003; A44C 5/107; A44C 5/0007; A44C 5/027; A44C 5/0053; A44C 5/102

See application file for complete search history.

(56) References Cited

U.S. PATENT DOCUMENTS

| | | | | |
|---|---|---|---|---|
| 5,081,852 | A * | 1/1992 | Cox | A44C 5/0084 63/3 |
| 5,748,571 | A * | 5/1998 | Jackl | A44C 5/02 224/164 |
| 6,442,970 | B1 * | 9/2002 | Dangelmayer | A44C 5/08 59/79.3 |
| 2014/0090418 | A1 * | 4/2014 | Mihalyo | A44C 5/0007 63/3 |
| 2017/0065010 | A1 * | 3/2017 | Brown | A41D 27/08 |
| 2017/0224070 | A1 * | 8/2017 | Simones | A44C 17/0208 |
| 2017/0311685 | A1 * | 11/2017 | Yamakawa | A44C 5/105 |

* cited by examiner

*Primary Examiner* — Corey N Skurdal
(74) *Attorney, Agent, or Firm* — Dunlap, Bennett & Ludwig PLLC; Brendan E. Squire

(57) ABSTRACT

A watch strap with a plurality of quickly interchangeable, decorative plates attached to express a person's characteristic or style. The watch strap allows for the removal of decorative plates on the watch strap via manipulating a "tab" attached to the plates. Another variation of the invention is to depress a button, attached to the plate, beneath the watch strap. The plates may also be removably secured via a plurality of screws.

16 Claims, 5 Drawing Sheets

WATCH BAND

CROSS-REFERENCE TO RELATED APPLICATION

This application is a continuation in part of U.S. design patent application No. 29/533,163 filed Jul. 15, 2015, the contents of which are herein incorporated by reference.

BACKGROUND OF THE INVENTION

The present invention relates to watch bands and, more particularly, to watch bands configured to changing a decorative appearance of the band.

Once a particular watch is manufactured, it continues to live life with the same appearance. This invention allows the ability to quickly change the appearance of your watch.

There are no other watch brand that allows a person to quickly remove decorative plates on their watch without the use of tools.

As can be seen, there is a need for an improved watch band with interchangeable decorative plates on a strap of the watchband.

SUMMARY OF THE INVENTION

In one aspect of the present invention, watchband with detachable faceplates for carrying decorative indicia is disclosed. On one embodiment, the watch band includes a plurality of interconnected band segments defining the watch band. At least one of the plurality of interconnected band segments has a faceplate that is detachable from the band segment. A surface of the faceplate has an area for carrying decorative indicia.

In some embodiments, a recessed area in an outer surface of the segment. A slot is defined in an interior sidewall of the recessed area. A notch is defined in the interior sidewall opposite the slot. A tab protrudes from an end of the faceplate and is configured for engagement with the slot. A latch protrudes from an opposite end of the faceplate and is configured for a snap fit engagement with the notch. A left and right side of the tab is carried within the notch when the faceplate is installed in the segment. An end of the tab may protrude from a lateral end of the notch.

In other aspects of the invention, a watch band has a band strap with a first end configured for attachment to a watch face and a second end having a coupling for attachment to a second end of a cooperating band strap. At least one detachable faceplate is received in at least one of the band strap or the cooperating band strap. The faceplate has an area for carrying decorative indicia.

A recessed area may be defined in an outer surface of at least one of the band strap or the cooperating band strap. At least one hole is defined in a surface of the recessed area. At least one post protrudes from an inner face of the faceplate, such that the post is configured for engagement with the at least one hole to retain the faceplate in the recessed area. The hole may extend through the band strap and the post may protrude through hole when installed in the band strap.

In yet other aspects of the invention, a watch band includes a band that attachable to a watch face at a first and a second end of the band. A coupling that is configured to secure the band about a wearer's wrist lies intermediate the first end and the second end. A plurality of detachable faceplates are carried by the band.

In some embodiments, an aperture extends through the plurality of detachable faceplates and a screw is received in the aperture to removably secure the faceplate to the band.

In some embodiments, an electronics module is carried in the recessed area. The electronics module may include one or more of a battery, a battery charger, a sensor, a camera, and a memory storage.

In other embodiments, a recessed area is defined in an outer surface of the band and the faceplate is detachably secured within the recessed area. A slot may be defined in an interior sidewall of the recessed area, with a notch defined in the interior sidewall opposite the slot. A tab protrudes from an end of the face plate and is configured for engagement with the slot. A latch protrudes from an opposite end of the faceplate and is configured for a snap fit engagement with the notch.

In other embodiments, at least one hole is defined in a surface of the recessed area. A least one post protrudes from an inner face of the faceplate. The post is configured for engagement with the at least one hole to retain the faceplate in the recessed area.

In yet other embodiments, a plurality of interconnected band segments define the watch band. At least one of the plurality of faceplates are carried by at least one of the plurality of interconnected band segments.

These and other features, aspects and advantages of the present invention will become better understood with reference to the following drawings, description and claims.

DETAILED DESCRIPTION OF THE INVENTION

Figure 1:
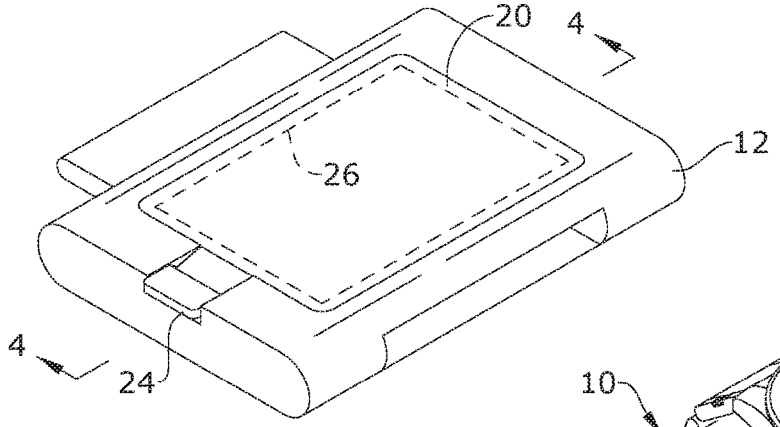
FIG. 1 is a perspective view of a single link segment of the band.
Figure 2:
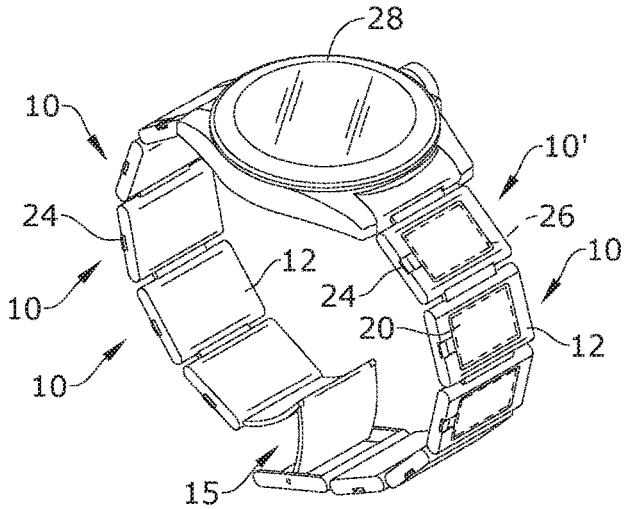
FIG. 2 is a perspective view of a first embodiment of a watchband with a plurality of segments.
Figure 3:
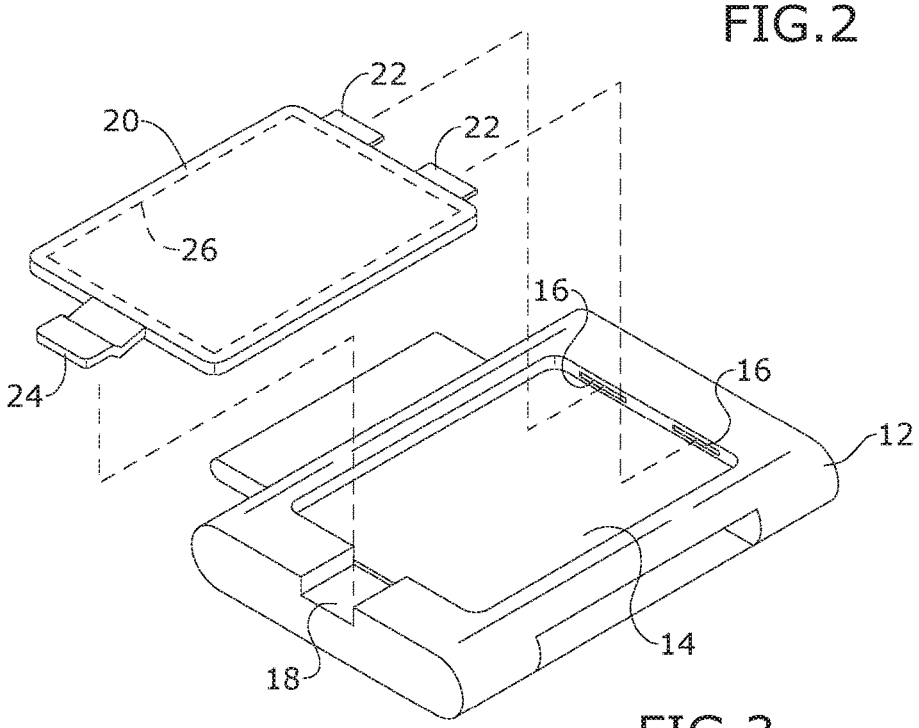
FIG. 3 is an exploded view of a segment.
Figure 4:
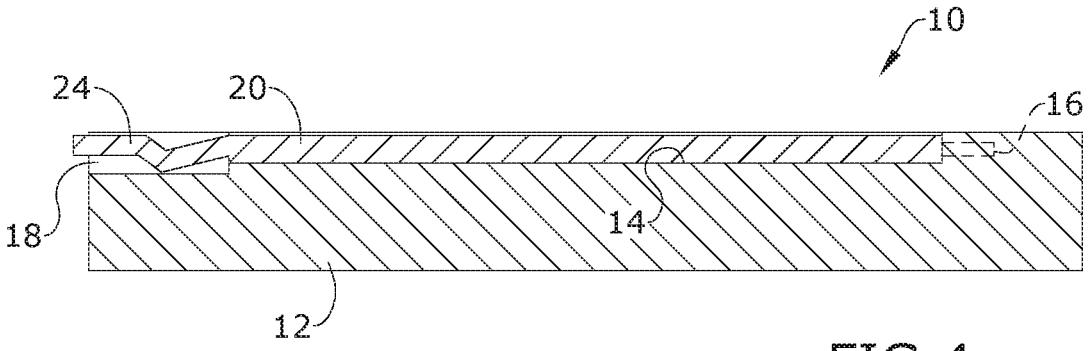
FIG. 4 is a section view of the segment, taken along line 4-4 in FIG. 1.
Figure 5:
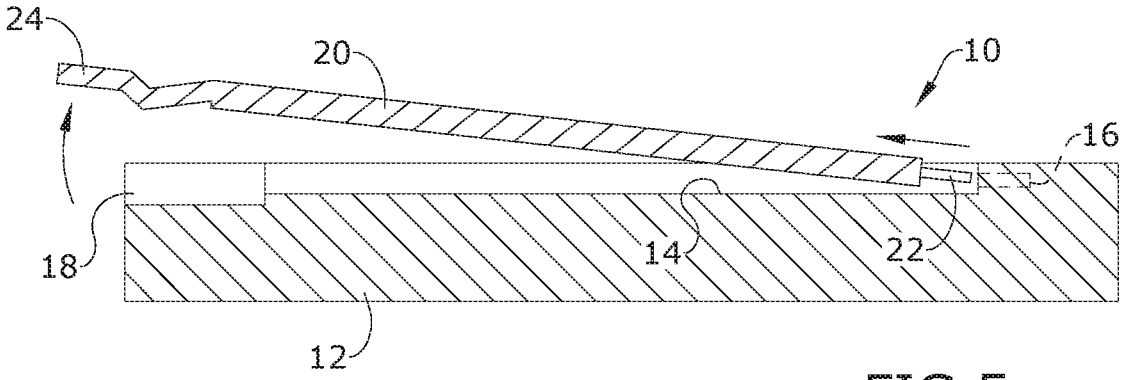
FIG. 5 is a section view of the segment, illustrating the removal of plate 20.
Figure 6:
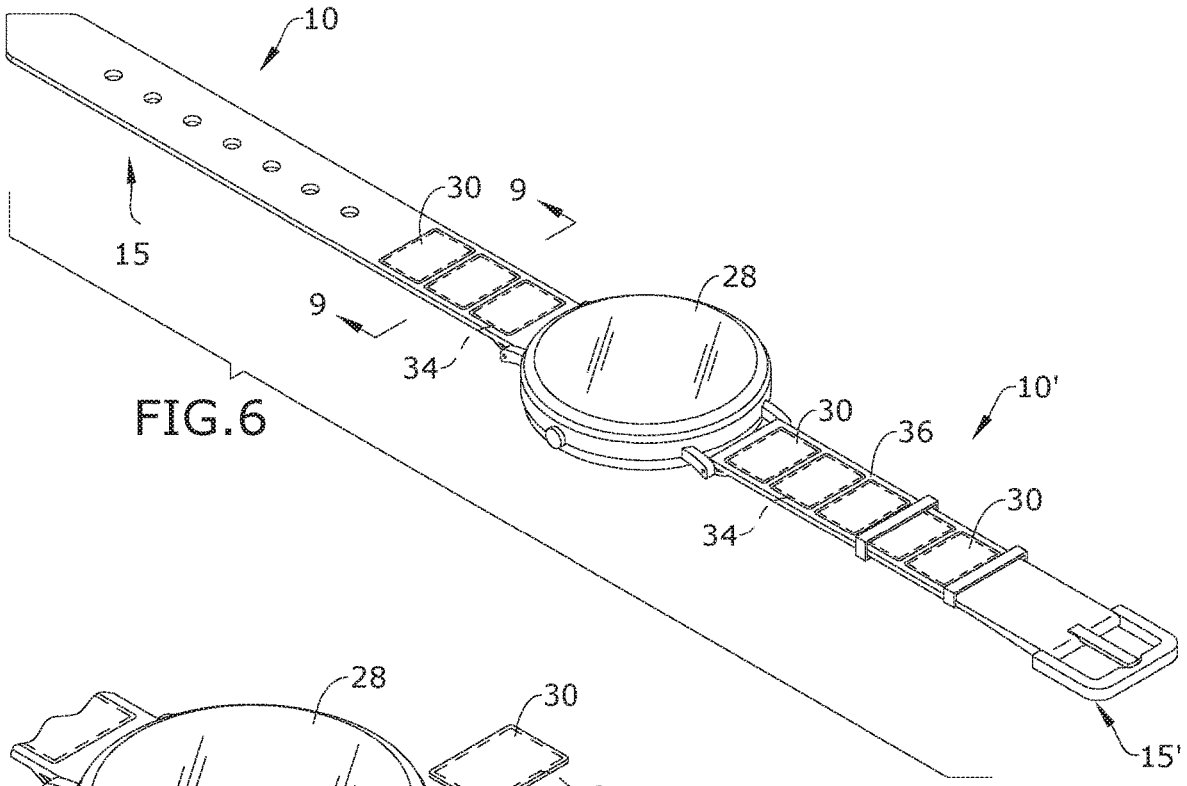
FIG. 6 is a perspective view of an alternate embodiment of the watchband having removable plates.
Figure 7:
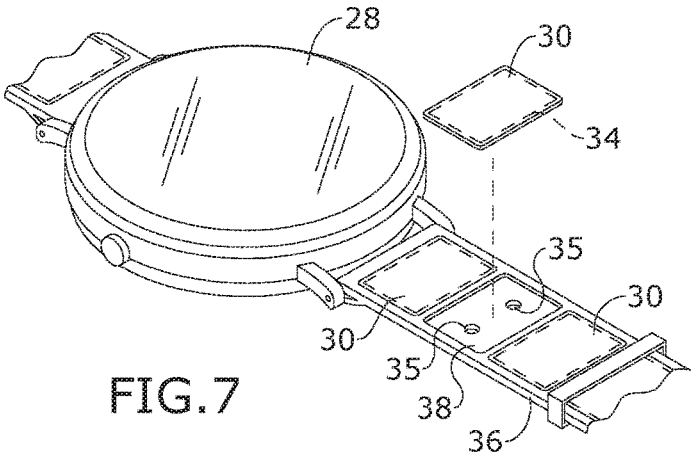
FIG. 7 is a top exploded view of the alternate embodiment of the watchband.
Figure 8:
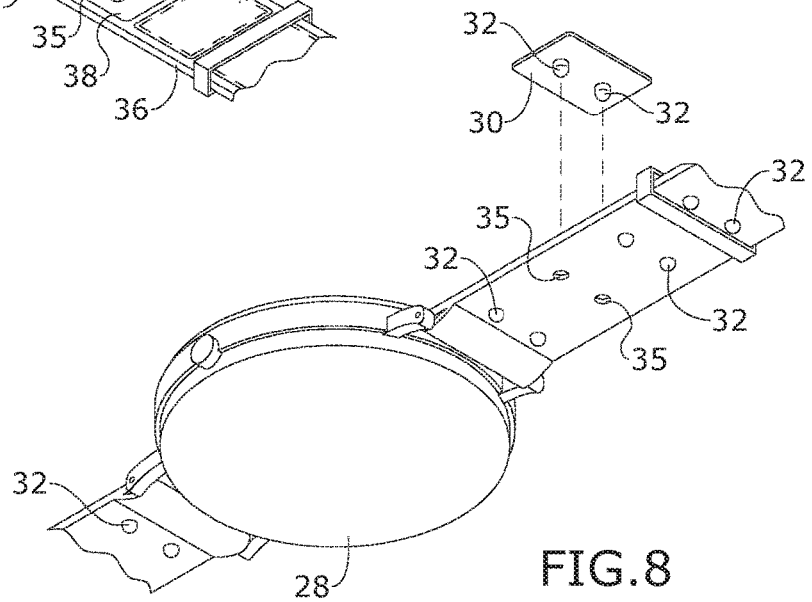
FIG. 8 is a bottom exploded view of the alternate embodiment of the watchband.
Figure 9:
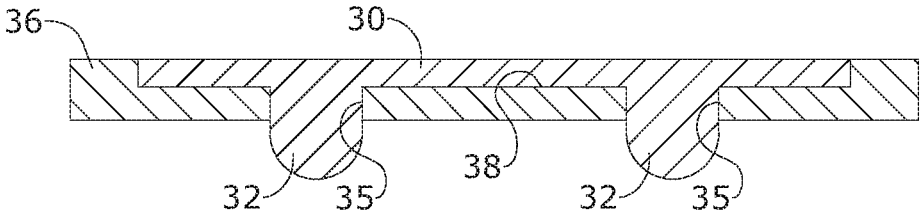
FIG. 9 is a section view of the watchband, taken along line 9-9 in FIG. 6.
Figure 10:
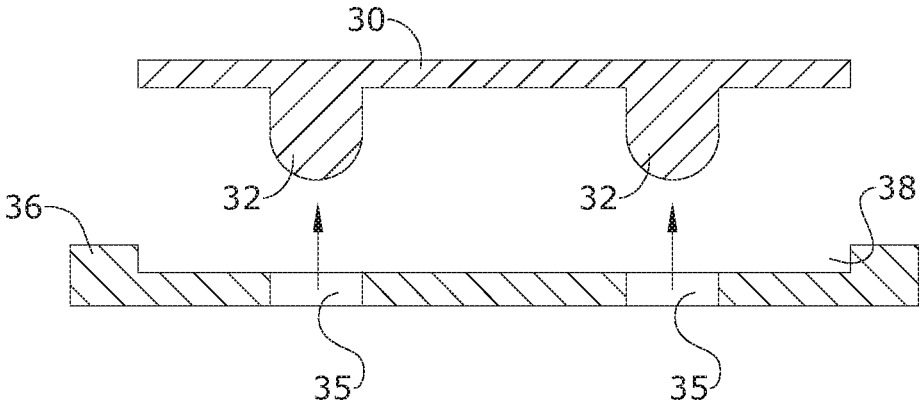
FIG. 10 is a section view of the watchband, illustrating the removal of plate 30.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a watchband with removable and interchangeable faceplates. The faceplates may have a decorative surface area for carrying a design, surface ornamentation, or other decorative indicia. The removable plates allows a user to readily change the appearance of their watch band.

As seen in reference to the drawings a watchband 10 has a fitting at a first end of the watchband 10 to attach the watchband 10 to a watch face 28. The watchband 10 has one or more removable faceplates 20, 30, 40 that are attached to the watchband 10. A second end of the watchband 10 has a coupling 15, 15' for interconnection to a second end of a cooperating band strap 10'.

In the embodiment shown n reference to FIGS. 1-5, the watchband 10 includes a plurality of interconnected band segments 12 that define the watch band 10. At least one of the plurality of interconnected band segments 12 has a faceplate 20 that is detachable from the band segment 12. A recessed area 14 is defined in in an outer surface of the segment 12. A slot 16 is defined in an interior sidewall of the recessed area 14. A notch 18 is defined in the interior sidewall opposite the slot 16.

In this embodiment, the faceplate 20 has a tab 22 protruding from a first end of the faceplate 20. The tab 22 is configured for cooperative engagement with the slot 16 to secure the first end of the faceplate 20 in the recessed area 14. A latch 24 protrudes from an opposite end of the faceplate 20. The latch 24 is configured for a snap fit engagement with the notch 18.

To remove the faceplate 20, the user would lift the latch 24 and withdraw the tab 22 from engagement with the slot 16. To install the faceplate 20, the user would engage the tab 22 within the slot 16 and lower the faceplate 20 to engage the latch 24 with the notch 18. A left and right side of the latch 24 is carried within the notch 18 when the faceplate is installed in the segment. An end of the latch may protrude from a lateral opening of the notch 18. The latch 24 may be slightly bent to facilitate lifting the faceplate 20 and disengaging the latch 24 from the notch 18, such as with a user's fingernail, or a tool.

In the embodiment shown in reference to FIGS. 6-10, the at least one detachable faceplate 30 is received in a recess 38 defined in at least one of the band strap 10 or the cooperating band strap 10', the faceplate 30 having a display area 34 for carrying decorative indicia. At least one hole 35 is defined in a surface of the recessed area 38. At least one post 32 protrudes from an inner face of the faceplate 30. The post 32 is configured for cooperative engagement, such as with a snap fit or interference fit, with the at least one hole 35 to retain the faceplate 30 in the recessed area 38. In some embodiments, the hole 34 extends through the band strap 10 and the post 32 protrudes through the hole 35 when installed in the band strap 10.

Figure 11:
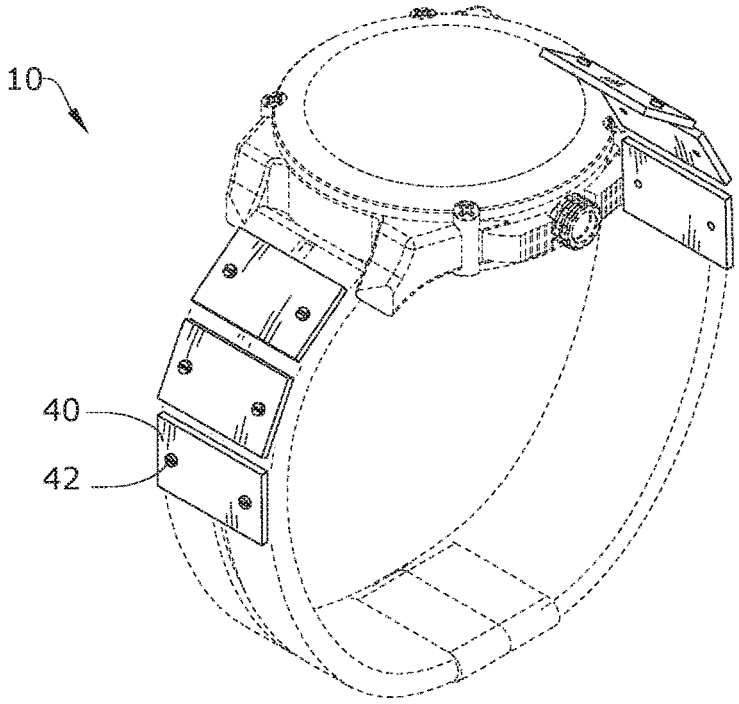
FIG. 11 is a perspective view of a watch band embodiment with plates removably secured by a fastener.
Figure 12:
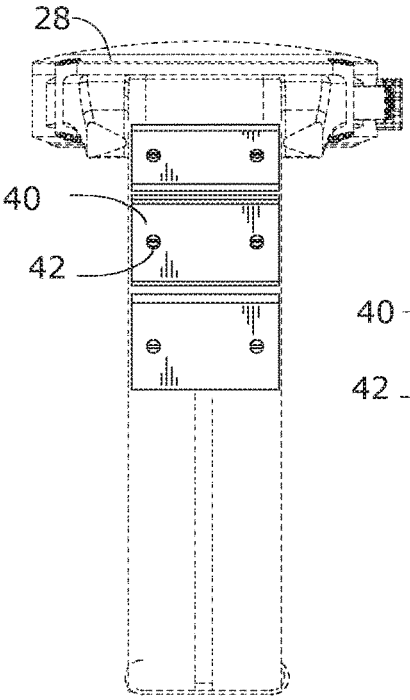
FIG. 12 is a side elevation view of the watch band with plates removably secured by a fastener.
Figure 13:
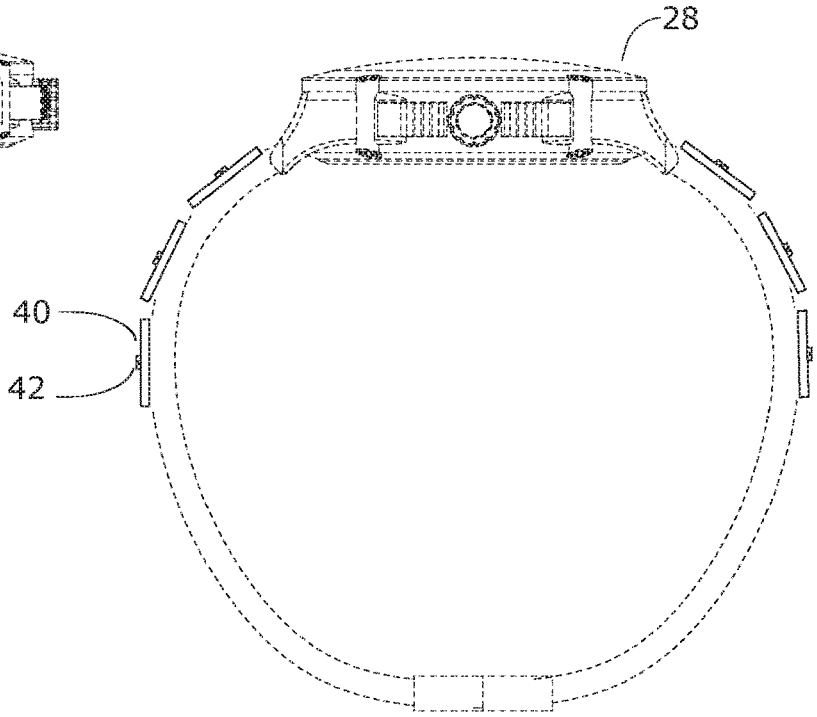
FIG. 13 is a frontal elevation view of the watch band with plates removably secured by a fastener.

In yet another embodiment shown in reference to FIGS. 11-13, a watch band 10 is attachable to a watch face 28 at a first and a second end of the band 10. A coupling is configured to secure the band 10 about a wearer's wrist intermediate the first end and the second end. A plurality of detachable faceplates 40 are carried by the band 10. An aperture extends through the plurality of detachable faceplates 40. A fastener 42, such as a screw, is received in the aperture to removably secure the faceplate 40 to the band 10. A recessed area may be defined in an outer surface of the band 10 and the faceplate 40 may be detachably secured within the recessed area.

In some embodiments, the recessed area 14 may define an interior cavity when the faceplate 20, 30, 30 is installed. The interior cavity may provide a space in which electronics accompanying the watch face 28 are housed. Alternatively, the electronics may be one or more sensors to communicate with a mobile computing device, such as a smartphone. The electronics may allow for the attachment of other technologies, such as a camera, an extended battery, a solar or inductive charger, and even an additional memory space to cooperate with a "smart watch" face 28. With the watchband 10 of the present invention the capabilities of a "smart watch" may be augmented to make it "smarter", allowing a more enjoyable user interface. The watchband 10 of the present invention can be used to create a custom bracelet, where the decorative plates 20, 30, 40 are attached 360 degrees onto the strap 10 of the bracelet It should be understood, of course, that the foregoing relates to exemplary embodiments of the invention and that modifications may be made without departing from the spirit and scope of the invention as set forth in the following claims.

What is claimed is:

1. A watch band, comprising:

a plurality of interconnected band segments defining the watch band;

at least one of the plurality of interconnected band segments having a faceplate that is detachable from the band segment;

a recessed area in an outer surface of the at least one of the plurality of band segments, a slot defined in an interior sidewall of the recessed area, a notch defined in the interior sidewall opposite the slot;

a tab protruding from and end of the faceplate, the tab configured for engagement with the slot, a latch protruding from an opposite end of the faceplate, the latch configured for a snap fit engagement with the notch; and a surface of the faceplate having an area for carrying decorative indicia.

2. The watchband; of claim 1, wherein a left and right side of the latch is carried within the notch when the faceplate is installed in the segment.

3. The watchband of claim 2, wherein an end of the latch protrudes from a lateral end of the notch.

4. The watch band of claim 1, further comprising:

an electronics module carried in the recessed area.

5. The watchband of claim 4, wherein the electronics module comprises one or more of a battery, a battery charger, a sensor, a camera, and a memory storage.

6. A watch band, comprising:

a band strap having a first end configured for attachment to a watch face and a second end having a coupling for attachment to a second end of a cooperating band strap;

a recessed area defined in an outer surface of at least one of the band strap or the cooperating band strap;

at least one hole defined in a surface of the recessed area;

at least one detachable faceplate received in at least one of the band strap or the cooperating band strap, the faceplate having an area for carrying decorative indicia; and at least one post protruding from an inner face of the faceplate, the post configured for engagement with the at least one hole to retain the faceplate in the recessed area.

7. The watch band of claim 6, wherein the hole extends through the band strap and the post protrudes through hole when installed in the band strap.

8. A watch band comprising:

a band attachable to a watch face at a first and a second end of the band;

a coupling configured to secure the band about a wearer's wrist intermediate the first end and the second end;

a plurality of detachable faceplates carried by the band;

an aperture extending through the plurality of detachable faceplates; and a screw received in the aperture to removably secure the faceplate to the band.

9. The watch band of claim 8, further comprising:

a recessed area defined in an outer surface of the band; and the faceplate is detachably secured within the recessed area.

10. The watch band of claim 9, further comprising:

a slot defined in an interior sidewall of the recessed area;

a notch defined in the interior sidewall opposite the slot;

a tab protruding from an end of the faceplate, the tab configured for engagement with the slot;

and a latch protruding from an opposite end of the faceplate, the latch configured for a snap fit engagement with the notch.

11. The watch band of claim 9, further comprising:

at least one hole defined in a surface of the recessed area; and at least one post protruding from an inner face of the faceplate, the post configured for engagement with the at least one hole to retain the faceplate in the recessed area.

12. The watch band of claim 9, further comprising:

an electronics module carried in the recessed area.

13. The watchband of claim 12, wherein the electronics module comprises one or more of a battery, a battery charger, a sensor, a camera, and a memory storage.

14. The watch band of claim 8, further comprising:

a plurality of interconnected band segments defining the watch band; and at least one of the plurality of faceplates are carried by at least one of the plurality of interconnected band segments.

15. The watch band of claim 8, further comprising:

an electronics module carried in the recessed area.

16. The watchband of claim 15, wherein the electronics module comprises one or more of a battery, a battery charger, a sensor, a camera, and a memory storage.

* * * * *